US006974379B2

(12) United States Patent
Koessler

(10) Patent No.: US 6,974,379 B2
(45) Date of Patent: Dec. 13, 2005

(54) VENT APPARATUS WITH REPLACEABLE VENT COVER

(76) Inventor: Juergen Koessler, 902-1736 West 10th Avenue, Vancouver, British Columbia (CA) V6J 2A6

( * ) Notice: Subject to any disclaimer, the term of this patent is extended or adjusted under 35 U.S.C. 154(b) by 34 days.

(21) Appl. No.: 10/612,270

(22) Filed: Jul. 3, 2003

(65) Prior Publication Data

US 2005/0003755 A1 Jan. 6, 2005

(51) Int. Cl.[7] ..... H05K 5/00
(52) U.S. Cl. ..... 454/184; 454/367; 454/368
(58) Field of Search ..... 454/367, 368, 454/359; 52/199, 198

(56) References Cited

U.S. PATENT DOCUMENTS

| | | | | |
|---|---|---|---|---|
| 2,052,315 | A * | 8/1936 | Riesner | 454/367 |
| 2,551,223 | A * | 5/1951 | Schneider | 454/366 |
| 3,842,722 | A * | 10/1974 | Miller | 454/359 |
| 4,625,630 | A * | 12/1986 | Carroll et al. | 454/182 |
| 5,435,780 | A * | 7/1995 | Ayles | 454/199 |
| 5,632,678 | A * | 5/1997 | Doelfel | 454/366 |
| 5,662,522 | A * | 9/1997 | Waltz | 454/359 |
| 6,299,529 | B1 * | 10/2001 | Preston | 454/367 |
| 6,302,788 | B1 * | 10/2001 | Gagnon | 454/367 |
| 6,361,433 | B1 * | 3/2002 | Gray | 454/358 |

FOREIGN PATENT DOCUMENTS

| | | |
|---|---|---|
| CA | 1288856 | 9/1989 |
| CA | 2062907 | 9/1993 |
| CA | 2357531 | 3/2003 |

OTHER PUBLICATIONS

Advertisement: RAINDOG light mounting bracket model LM01, Raindog Building Products.

* cited by examiner

*Primary Examiner*—Derek S. Boles
(74) *Attorney, Agent, or Firm*—Oyen Wiggs Green & Mutala LLP

(57) ABSTRACT

A vent, together with one or more building apertures, provides a route for gas exchange through a building surface. The vent comprises a base member having a vent aperture therethrough and a generally planar mounting flange on its perimeter. The base member may be mounted within a building surface such that the mounting flange extends between an internal building surface layer and one or more external building surface layers and the vent aperture is in fluid communication with the one or more building apertures. The vent also comprises a vent cover which is removably mountable to the base member when the base member is mounted within the building surface. The vent cover has a hood member which projects downwardly and outwardly from the base member for conveying moisture away from the vent aperture. A bottom drainage flange may project outwardly and downwardly from beneath the vent aperture to convey moisture downwardly and outwardly past an outermost one of the one or more external building layers.

42 Claims, 15 Drawing Sheets

VENT APPARATUS WITH REPLACEABLE VENT COVER

TECHNICAL FIELD

The invention pertains to vent apparatus which, together with their associated building aperture(s), provide a route for the exchange of air and/or other gases through a building envelope.

BACKGROUND

Typical buildings comprise building apertures which provide a route for exchange, ventilation, circulation and/or movement of gas through the building envelope. Such gases may comprise air or water vapour, for example. Buildings may have ventilation systems, which take in "fresh" air from outside of the building and expel "stale" air from inside the building. Fresh air may be taken into a building or stale air may be expelled from a building through one or more building apertures. Some buildings incorporate other systems and/or apparatus, such as air conditioning systems and forced air clothes dryers, which require gas exchange between the inside and outside of a building through building aperture(s).

Buildings may comprise vent apparatus, each of which is associated with one or more building apertures. Such vent apparatus (or simply "vents") are typically in fluid communication with their one or more associated building aperture(s) to provide a means for gas exchange through the building envelope. Vents may provide a number of additional functions. For example, vents may comprise weatherproofing features to minimize the amount of moisture which flows into their associated building aperture(s). Vents may provide a more aesthetically pleasing terminus for their associated building aperture(s). Vents may also incorporate means to control the flow of gases and/or other materials through their associated building aperture(s). For example, vents may restrict the back-flow of expelled gases or other external matter through their associated building aperture(s) and into the interior of the building.

There are many vent designs known in the art. For example:

- Canadian patent No. 2,062,907 (Sirjoo) discloses a vent incorporating an adjustable screw cap vent cover which extends outwardly from the external wall of a building and which is adjustable to permit air flow through the vent when the cap is open and to prevent air flow through the vent when the cap is closed; and
- Canadian patent No. 2,357,531 (Myint) shows a security air vent which allows for the flow of air, but which comprises a screen having S-shaped structural members for preventing the back flow of solids or liquids into the associated building aperture.

Vents may be installed in a variety of external building surfaces, such as the walls or the roof, for example. Vents are typically installed between the layers of a building's external surface, during construction and/or finishing. For example, vents may include one or more laterally and/or vertically extending flange(s) which are installed between an interior sheathing layer and an exterior siding layer of a building wall. The installation of vents between the interior and exterior layers of a building wall causes difficulties when the vent must be replaced (for example, when the vent is broken). Replacement of such vents requires dismantling one or more exterior layer(s) of the wall in a vicinity of the vent. Once the exterior wall layer(s) are removed from the vicinity of the vent, the damaged vent may be removed and/or replaced. After replacement of the vent, the exterior wall layer(s) must be rebuilt around the new vent. For this reason, vent replacement can be an expensive, arduous and time-consuming task.

Some vent apparatus comprise a vent cover which extends outwardly from the exterior surface of the building. Such vent covers may provide weatherproofing for the vent and its associated building aperture(s) and may also provide desirable aesthetics. Vents and vent covers are typically formed in a single unitary construction.

Vent covers are particularly susceptible to damage which may be caused, for example, by exposure to natural elements (i.e. weather and temperature), age, physical blows, etc. Because of the unitary construction of vents and vent covers, however, replacement of a damaged vent cover usually requires replacement of the entire vent apparatus, which requires dismantling and rebuilding of the building surface layer(s) as described above.

Vents and their associated building aperture(s) cause an interruption in the external surfaces of buildings. If a vent is not adequately sealed, moisture may intrude into or between the layers of the building surface, damaging the building surface over time and eventually resulting in the need for repair or replacement of the building surface. Moisture or other foreign material may also intrude past the vent, into the associated building aperture(s) and possibly into the building itself. For these reasons, there is a general desire to provide vents which deter inward movement of moisture and other foreign material through the vent and prevent or minimize the intrusion of moisture between building surface layers.

SUMMARY OF THE INVENTION

A first aspect of the invention provides a vent, which together with one or more building apertures, provides a route for gas flow through a building surface. The vent comprises a base member having a vent aperture therethrough and a generally planar mounting flange on at least a portion of its perimeter. The base member may be mounted within a building surface such that at least a portion of the mounting flange extends between an internal building surface layer and one or more external building surface layers and the vent aperture is in fluid communication with the one or more building apertures. The vent also comprises a vent cover which is removably mountable to the base member when the base member is mounted within the building surface. The vent cover has a hood member which projects downwardly and outwardly from the base member for conveying moisture away from the vent aperture.

The base member may comprise an outwardly projecting intermediate base flange which is spaced apart from the vent aperture. The intermediate base flange may have a bottom drainage flange which projects outwardly and downwardly from beneath the vent aperture for conveying moisture outwardly past the outermost one of the one or more external building surface layers.

The intermediate base flange may have a pair of outwardly projecting side portions which extend upwardly from above the bottom drainage flange on either side of the vent aperture. The intermediate base flange may have an outwardly projecting upper portion which is located above the vent aperture and which extends between the two side portions. The upper portion of the intermediate base flange may comprise a transversely extending main section and a pair of wells. Each of the wells may extend downwardly and transversely from a corresponding transverse end of the main section to meet with a corresponding one of the side portions at a location which is below the upwardmost end of the side portion. An upper surface of the hood member may fit under the upper portion of the intermediate base flange.

When the base member is mounted within the building surface, the one or more external building surface layers may abut against the side portions and the upper portion of the intermediate base flange. The one or more external building surface layers may also abut against an undersurface of the bottom drainage flange.

The bottom drainage flange may comprise two side edges located on either side of the vent aperture. The side portions of the intermediate base flange may extend upwardly from the bottom drainage flange at locations that are closer to the vent aperture than the side edges of the bottom drainage flange. Each side edge may have a dam which projects upwardly from the side edge for preventing moisture received on an upper surface of the bottom drainage flange from travelling transversely past the side edges of the bottom drainage flange. The dams may be aligned vertically with the side portions of the intermediate base flange.

The vent cover may comprise an apertured grille which extends inwardly from an outer edge of the hood member. The vent may comprise one or more notched ribs for receiving an inward edge of the grille.

The base member may comprise an interior base flange, an inner portion of which projects inwardly into the one or more building apertures. An outer portion of the interior base flange may project outwardly. The interior base flange may be located on a perimeter of the vent aperture.

The vent may include a damper member which is pivotally coupled to the base member. Preferably, the vent aperture is sized to prevent the damper member from pivoting therethrough. The damper member may be removably coupled to the base member or the vent cover.

The mounting flange of the base member may project from a transverse and/or vertical side of the vent aperture to form a transverse and/or vertical part of the perimeter of the base member.

Another aspect of the invention provides a base member for a vent, which together with one or more building apertures, provides a route for gas flow through a building surface. The base member comprises a generally planar mounting flange on at least a portion of its perimeter for mounting the base member within a building surface. When the base member is mounted within the building surface, at least a portion of the mounting flange extends between an internal building surface layer and one or more external building surface layers. The base member also comprises a vent aperture, which is in fluid communication with the one or more building apertures when the base member is mounted within the building surface. The base member also comprises a bottom drainage flange which projects outwardly and downwardly from beneath the vent aperture for conveying moisture outwardly past an outermost one of the one or more external building surface layers.

Another aspect of the invention provides a vent, which together with one or more building apertures, provides a route for gas flow through a building surface. The vent comprises a means for mounting a base member between an internal building surface layer and one or more external building surface layers. The base member includes a vent aperture for fluid communication with the one or more building apertures. The vent also comprises a means for covering and conveying moisture away from the vent aperture, which is removably mountable to the base member when the base member is mounted between the building surface layers.

The vent may comprise a means for conveying moisture from within the building surface outwardly past an outermost one of the one or more external building surface layers.

Another aspect of the invention provides a vent comprising a base member and a vent cover. The base member has a substantially planar mounting flange on at least a portion of its perimeter, which is capable of being received between layers of a building surface, and a vent aperture extending between inward and outward sides of the base member. The vent cover is removably coupleable to the outward side of the base member. The vent cover comprises a hood member disposed to shield the vent aperture.

Another aspect of the present invention relates to a method for installing a vent within a building surface to provide fluid communication through one or more building apertures in the building surface. The method involves mounting a base member to an internal building surface layer such that a vent aperture in the base member is in fluid communication with the one or more building apertures. After mounting the base member, one or more external building surface layers are installed onto the internal building surface layer, such that the one or more external building surface layers overlap a portion of the of the base member. After installing the external building surface layer(s), a vent cover is removably mounted to the base member, the vent cover extending downwardly and outwardly from above the vent aperture to a location that is outside of the outermost one of the one or more external building surface layers.

Further aspects of the invention, features of specific embodiments of the invention and features and applications of the invention are described below.

BRIEF DESCRIPTION OF THE DRAWINGS

In drawings which depict non-limiting embodiments of the invention.

DETAILED DESCRIPTION

Throughout the following description, specific details are set forth in order to provide a more thorough understanding of the invention. However, the invention may be practised without these particulars. In other instances, well known elements have not been shown or described in detail to avoid unnecessarily obscuring the invention. Accordingly, the specification and drawings are to be regarded in an illustrative, rather than a restrictive, sense.

The invention disclosed herein relates to vents which, together with their associated building aperture(s), provide a route for the exchange of air or other gases through a building envelope. A building aperture may be connected to a conduit for transporting such gases. A conduit may comprise any aperture, duct, passageway, flume, spout, hose, tube, pipe, channel or other means of transporting fluids. Typical examples of conduits include, but are not limited to, air ducts for moving air within a building's heating, cooling or ventilation systems and exhaust hoses from forced-air clothes dryers and/or air conditioning systems.

Vents according to preferred embodiments of the invention comprise: a base including a transversely and/or vertically extending, substantially planar flange which may be installed between the layers of a building wall; at least one outwardly extending flange for diverting to the outdoors any moisture which may be moving downward within the layers of the building wall; and a removeable vent cover. The construction of the vent permits the vent cover to be replaced without dismantling the external layer(s) of the building wall. The vent cover extends downwardly and outwardly to deter the entrance of moisture and other foreign material into the associated building aperture(s). The vent may also comprise a damper member for restricting the flow of gas and other materials.

Figure 11:
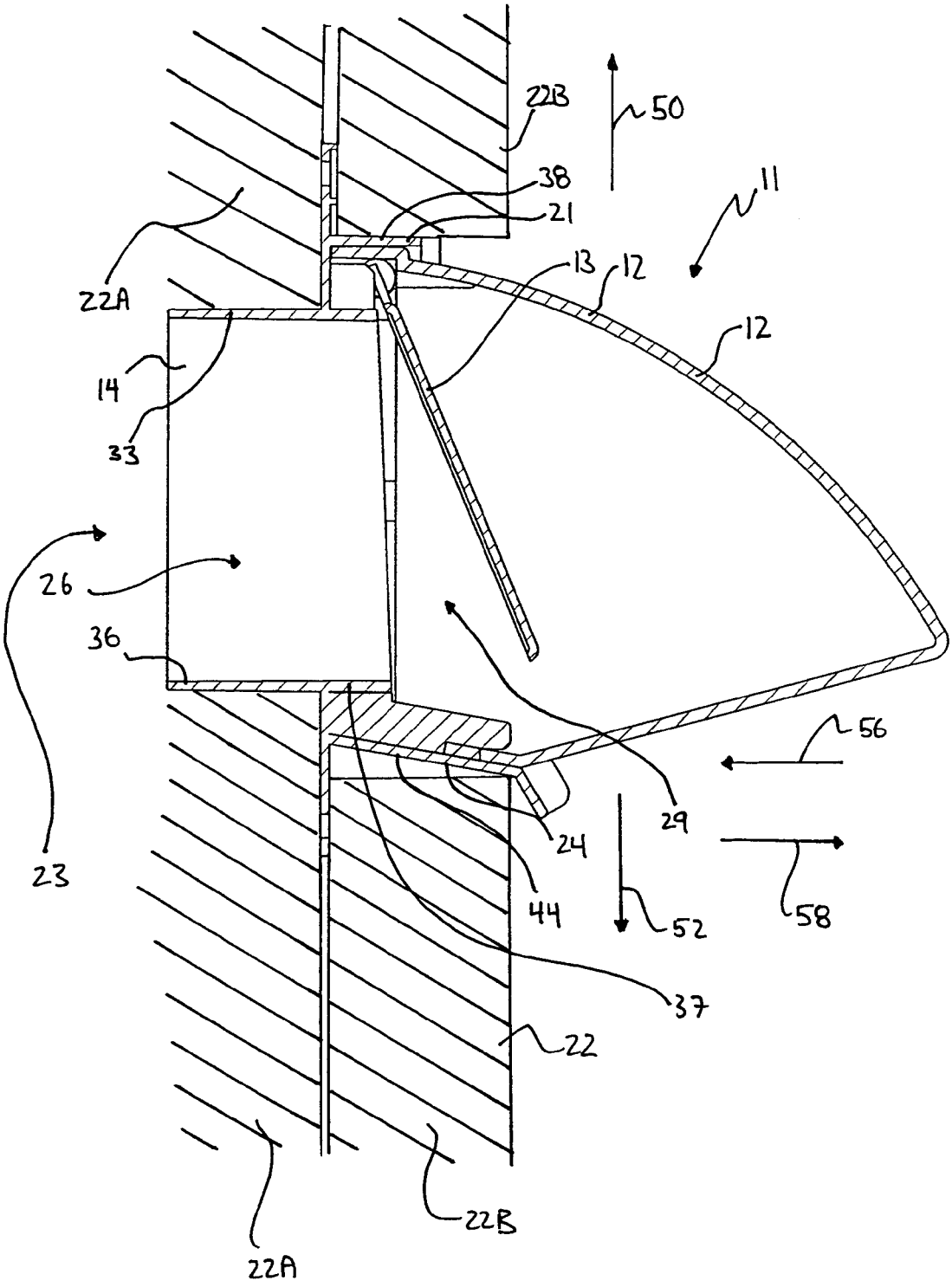
FIG. 11 is a cross-sectional view of the vent of FIG. 1 installed between the layers of an external building wall.

FIGS. 1 through 11 depict a vent 11 according to a particular embodiment of the invention. As shown most effectively in the exploded view of FIG. 7, vent 11 comprises: a vent cover 12, a damper member 13 and a base 14. Vent cover 12 and damper member 13 are removably mounted to base 14. Base 14 comprises a vent aperture 26 which permits the movement of gas through building aperture 23 (FIG. 11). Preferably, vent 11 and its components are made of plastic, but those skilled in the art will appreciate that vent 11 and/or some of its components may be constructed from a wide variety of suitable materials including suitable metals, plastics and the like.

Figure 1:
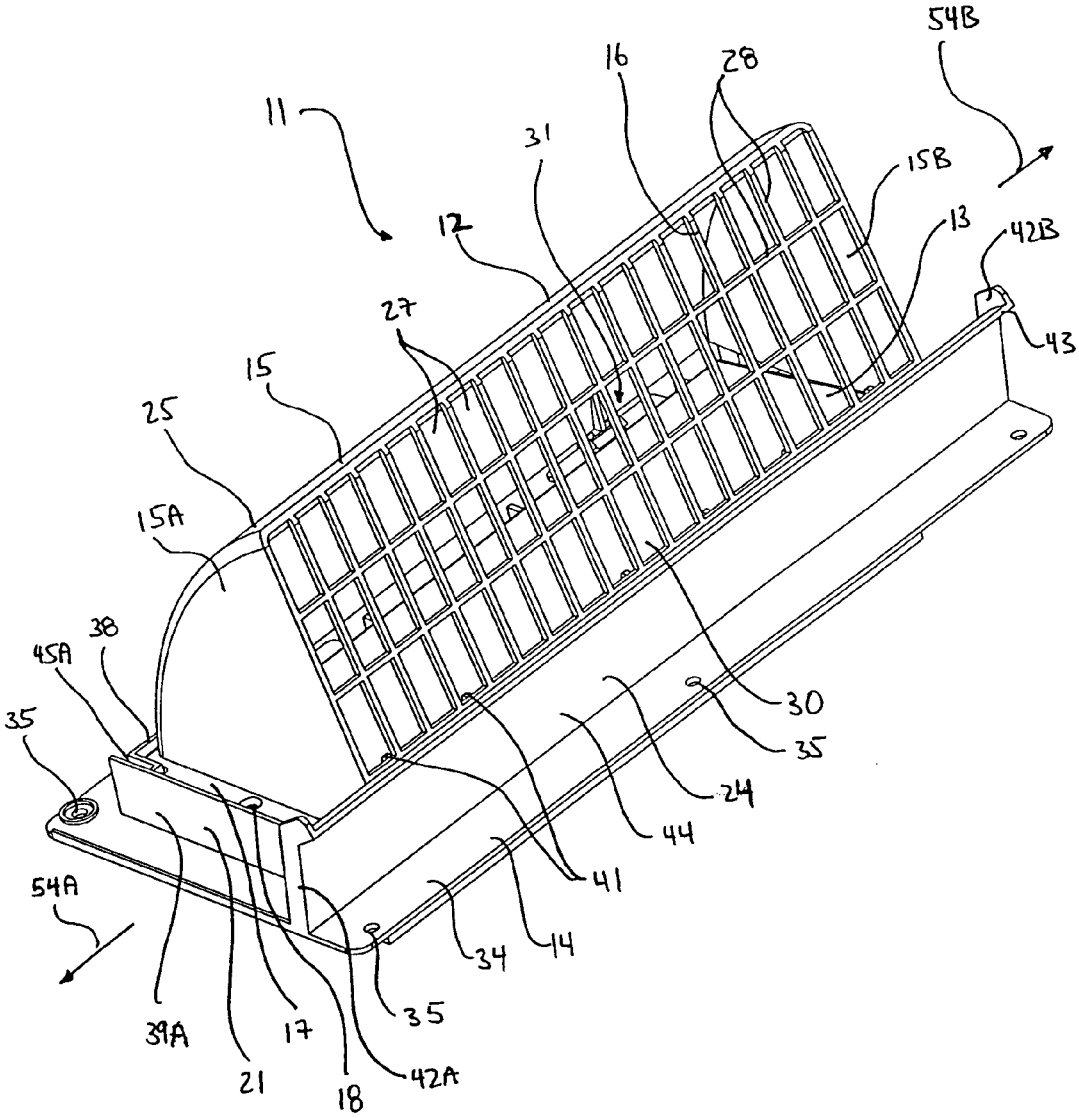
FIG. 1 is an isometric view of a vent according to one embodiment of the invention.
Figure 2:
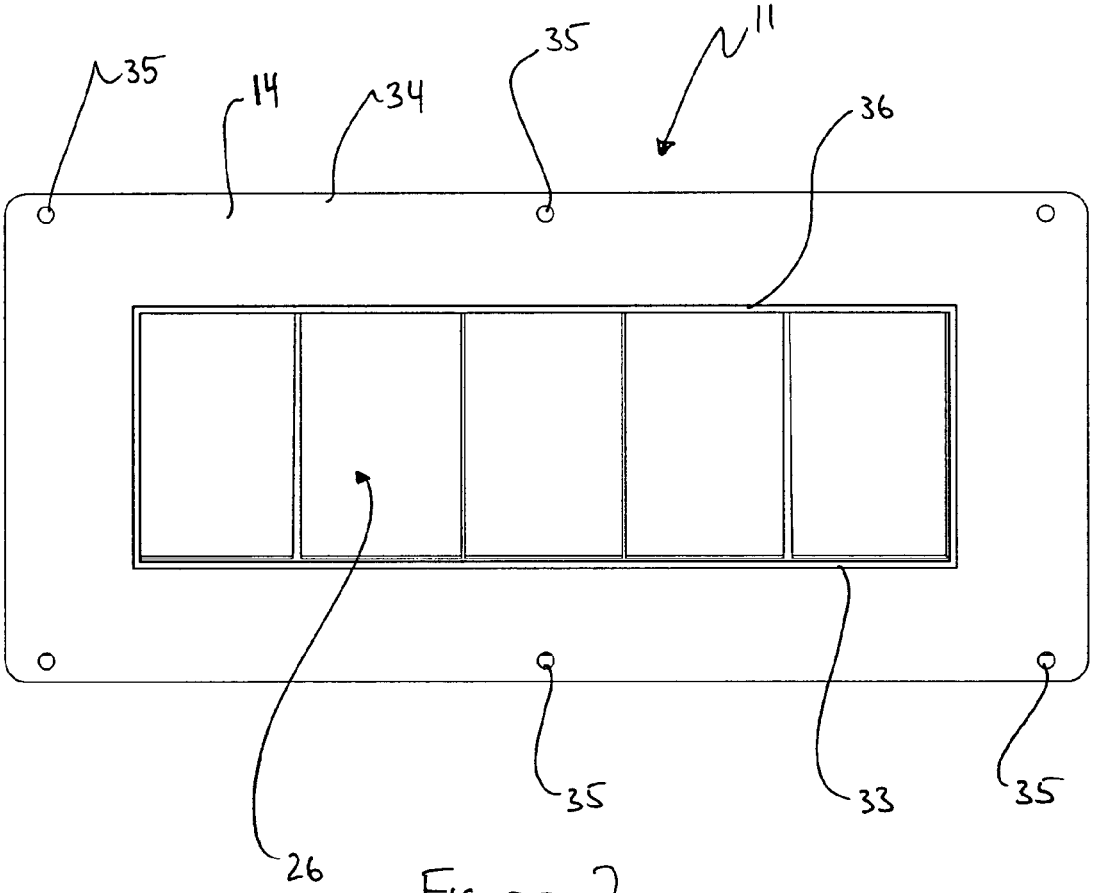
FIG. 2 is an elevated plan view of the back of the vent of FIG. 1.
Figure 3:
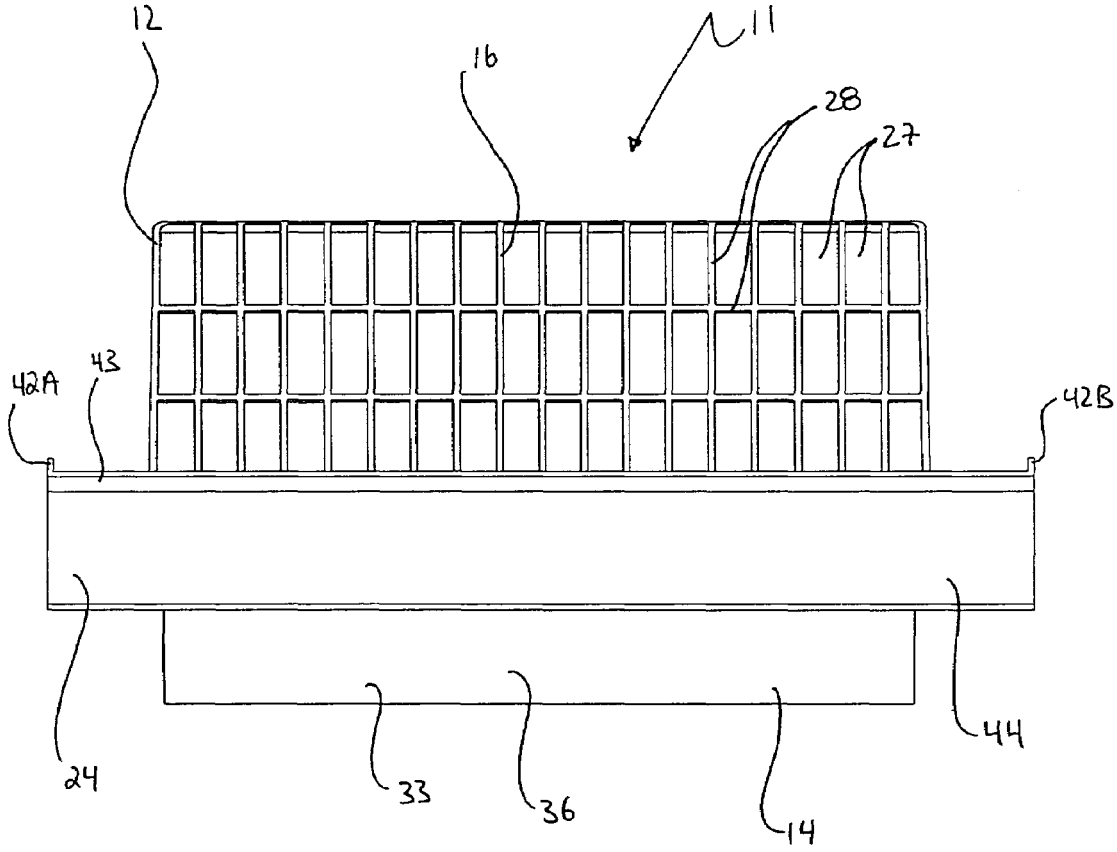
FIG. 3 is an elevated plan view of the bottom of the vent of FIG. 1.
Figure 4:
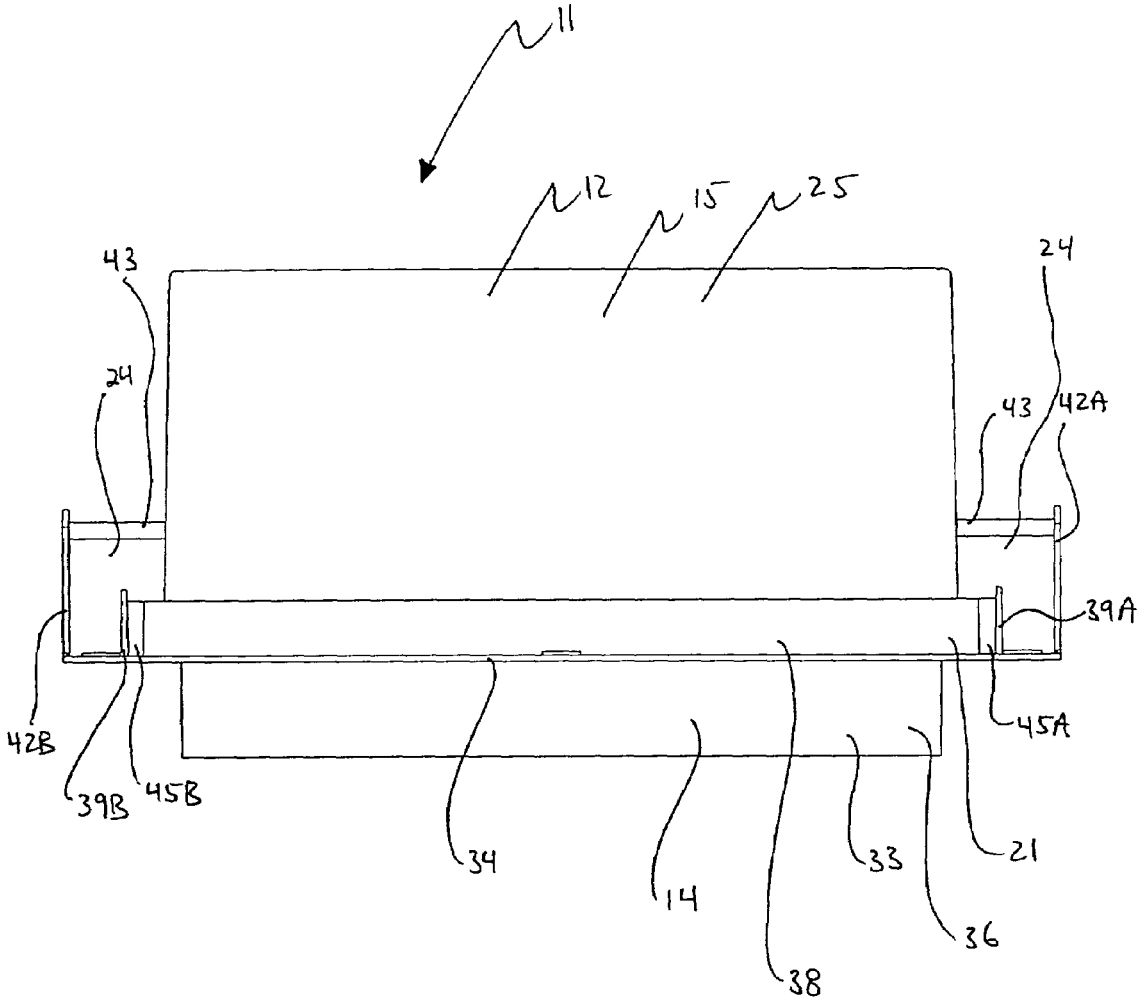
FIG. 4 is an elevated plan view of the top of the vent of FIG. 1.
Figure 5:
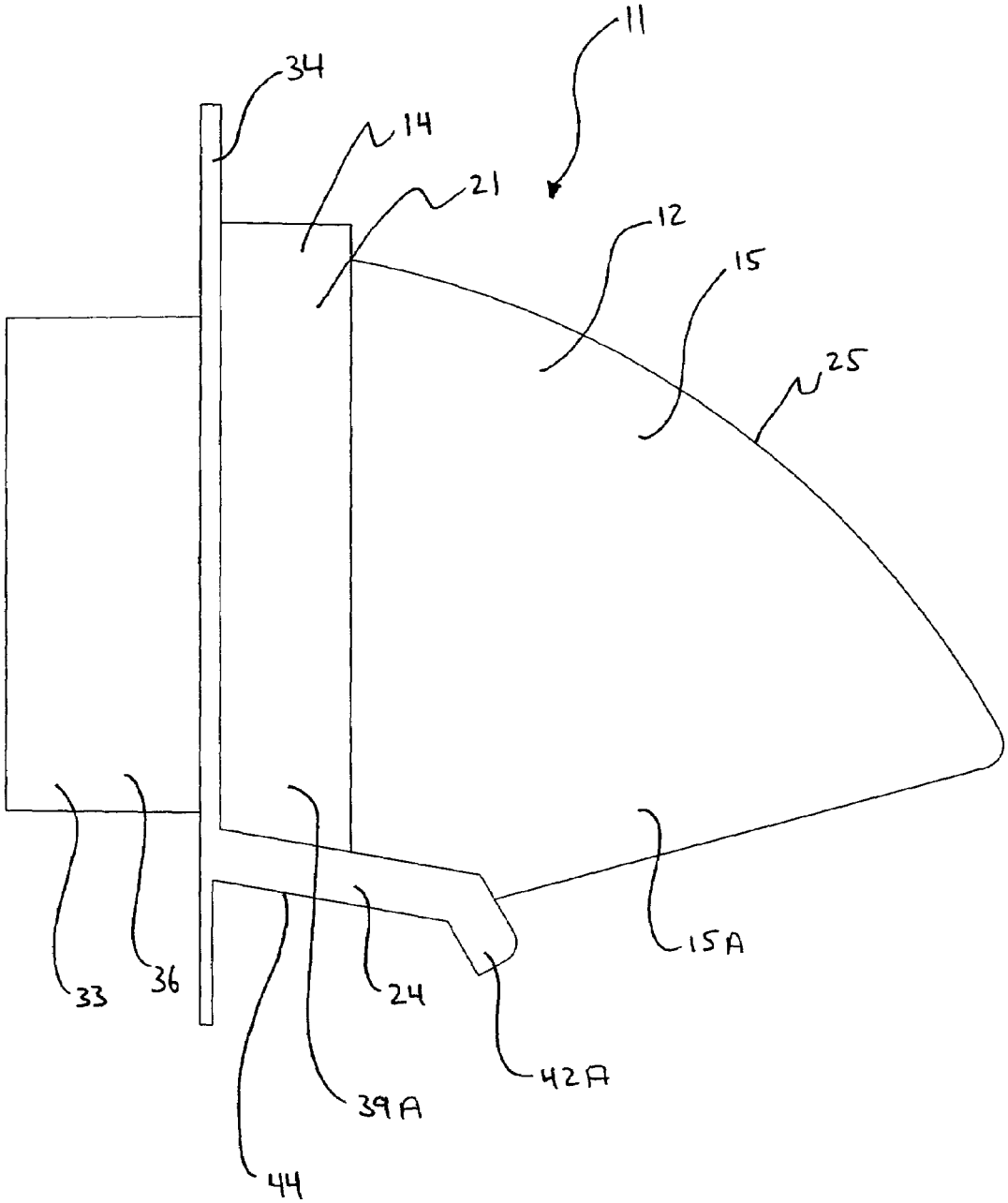
FIG. 5 is an elevated plan view of the right side of the vent of FIG. 1.

FIG. 11 depicts vent 11 installed in a vertical building wall 22 having an associated building aperture 23. The embodiments of the invention described herein are installed in building walls; accordingly, a number of directional conventions are used to clarify this description:

(i) "upward", "upwardly", "upwardmost" and similar words refer to a direction extending along wall 22 as indicated by arrow 50 (FIG. 11);

(ii) "downward", "downwardly", "downwardmost" and similar words refer to a direction extending along wall 22 as indicated by arrow 52 (FIG. 11);

(iii) "vertical", "vertically" and similar words refer to either of the upward or downward directions;

(iv) transverse", "transversely", "side", "sideways" and similar words refer to either direction that extends along wall 22 in a direction orthogonal to the upward and downward directions as indicated by arrows 54A, 54B (FIG. 1);

(v) "outward", "outwardly", "outwardmost" and similar words refer to a direction that extends away from wall 22 towards an exterior of the building as indicated by arrow 56 (FIG. 11); and, (vi) "inward", "inwardly", "inwardmost" and similar words refer to a direction that extends away from wall 22 towards an interior of the building as indicated by arrow 58 (FIG. 11).

Those skilled in the art will appreciate that wall 22 need not be strictly vertical and that the directional words used in this description should not be interpreted narrowly.

Vent cover 12 comprises a hood 15 and a grille 16 which may be formed in a unitary construction or which may be separate components that are connected to one another. Hood 15 comprises a hood aperture 29. Vent cover 12 is removably connected to base 14 such that hood aperture 29 is in fluid communication with vent aperture 26 and building aperture 23 (FIG. 11). In the illustrated embodiment, hood aperture 29 is larger than vent aperture 26. Vent cover flange 17 extends around the upper and side edges of hood aperture 29.

Figure 6:
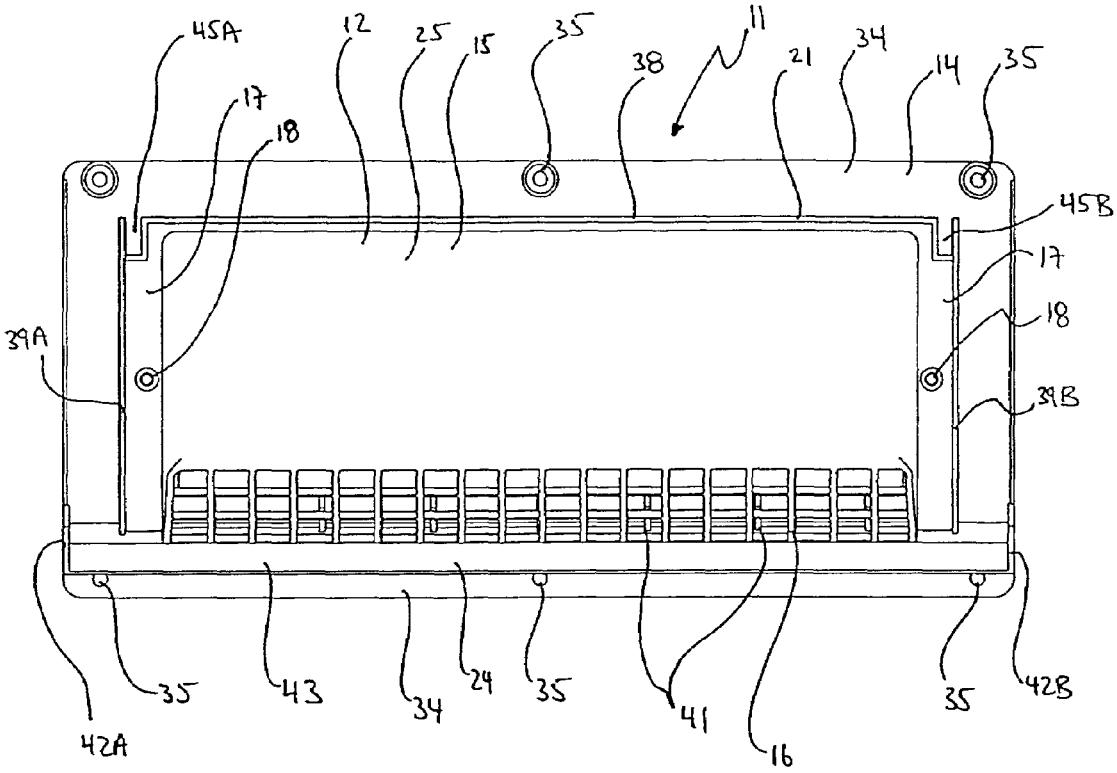
FIG. 6 is an elevated plan view of the front of the vent of FIG. 1.
Figure 7:
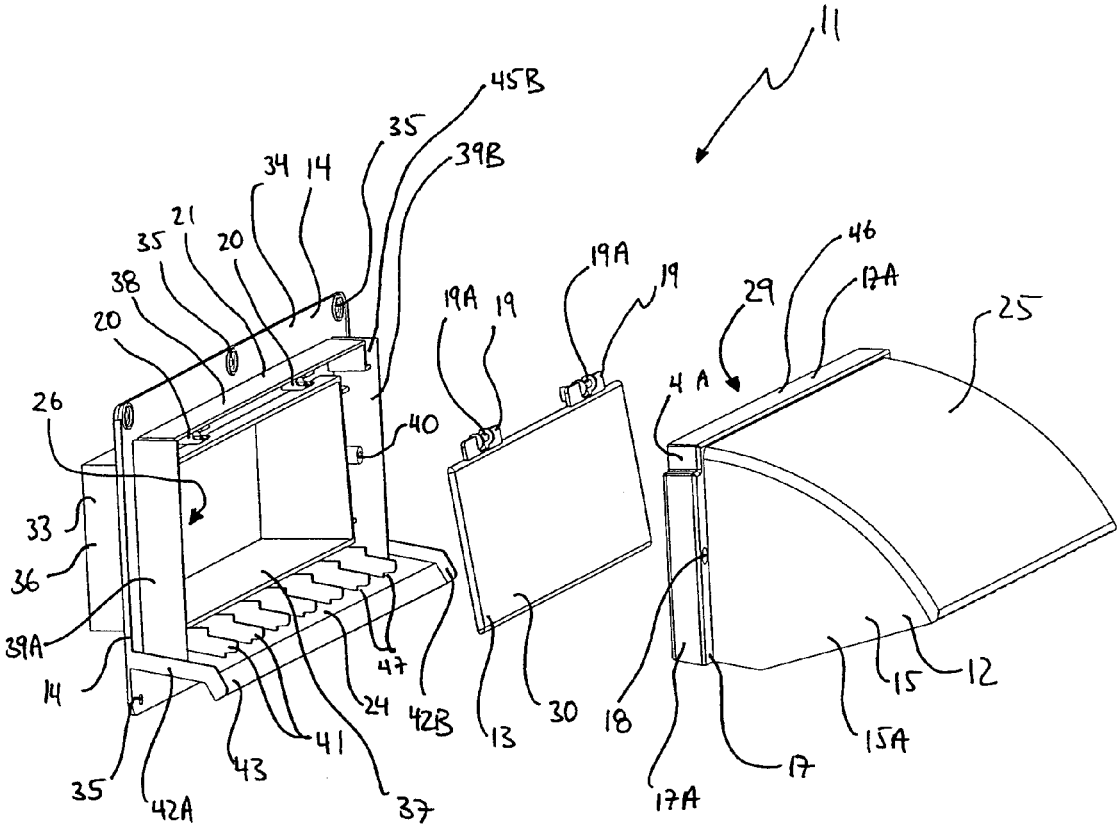
FIG. 7 is an exploded isometric view of the vent of FIG. 1.
Figure 8:
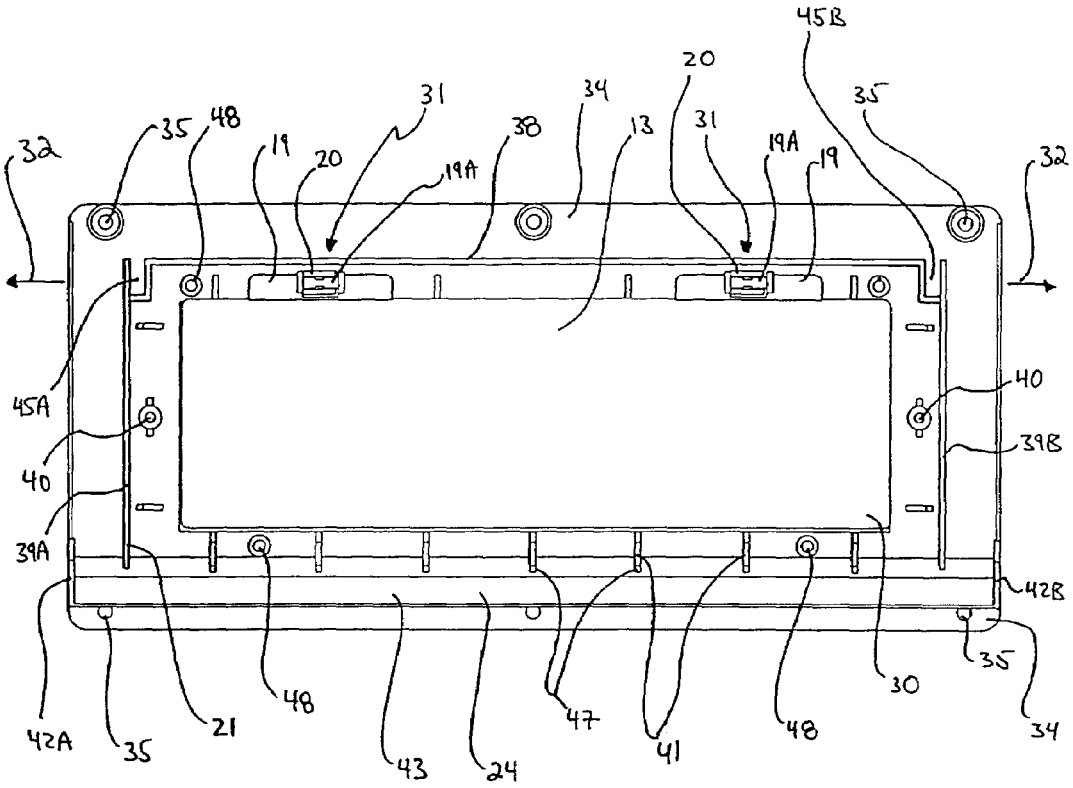
FIG. 8 is an elevated plan view of the front of the vent of FIG. 1 with the vent cover removed.
Figure 9:
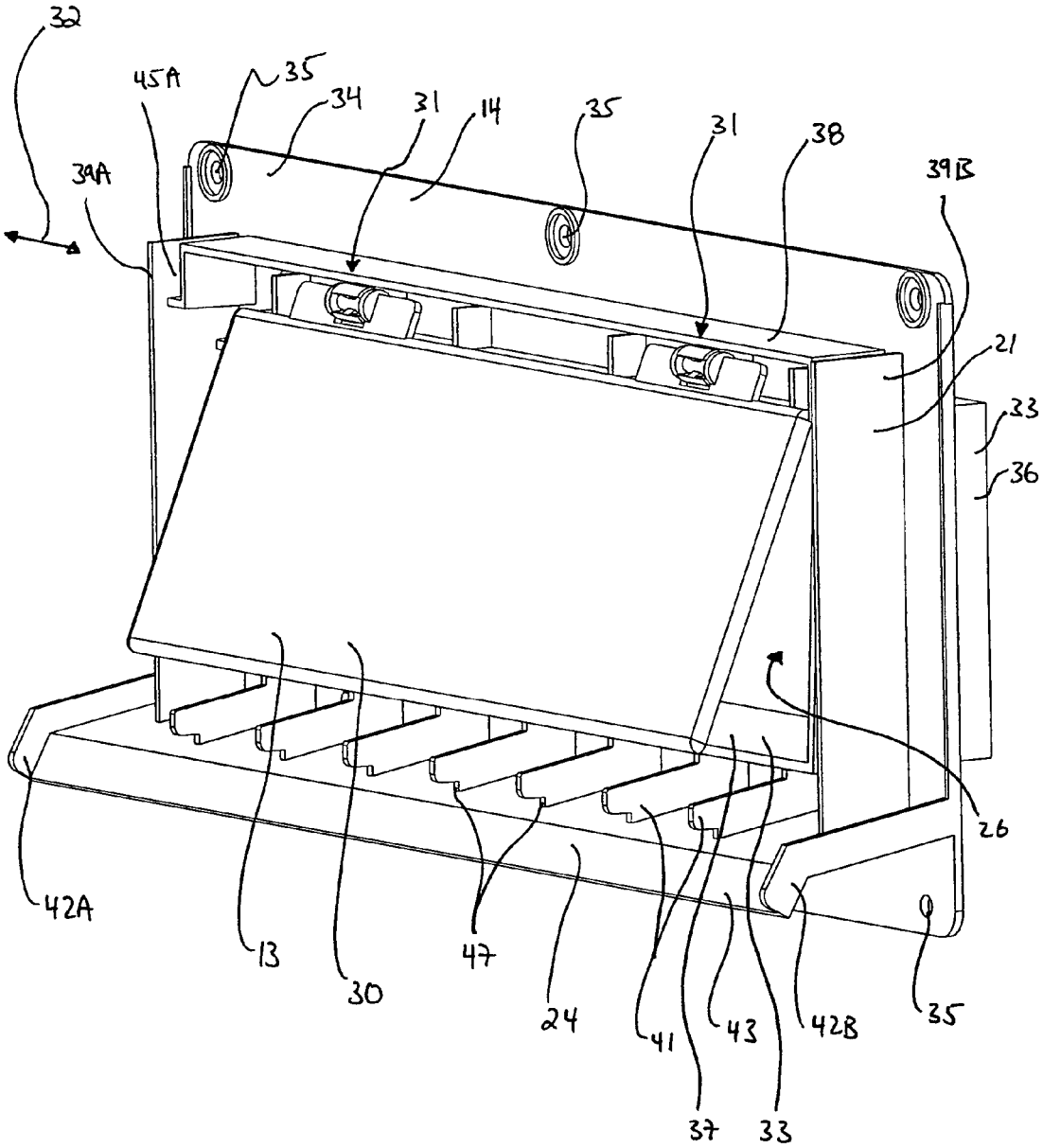
FIG. 9 is an isometric view of the vent of FIG. 1 with the vent cover removed.
Figure 10:
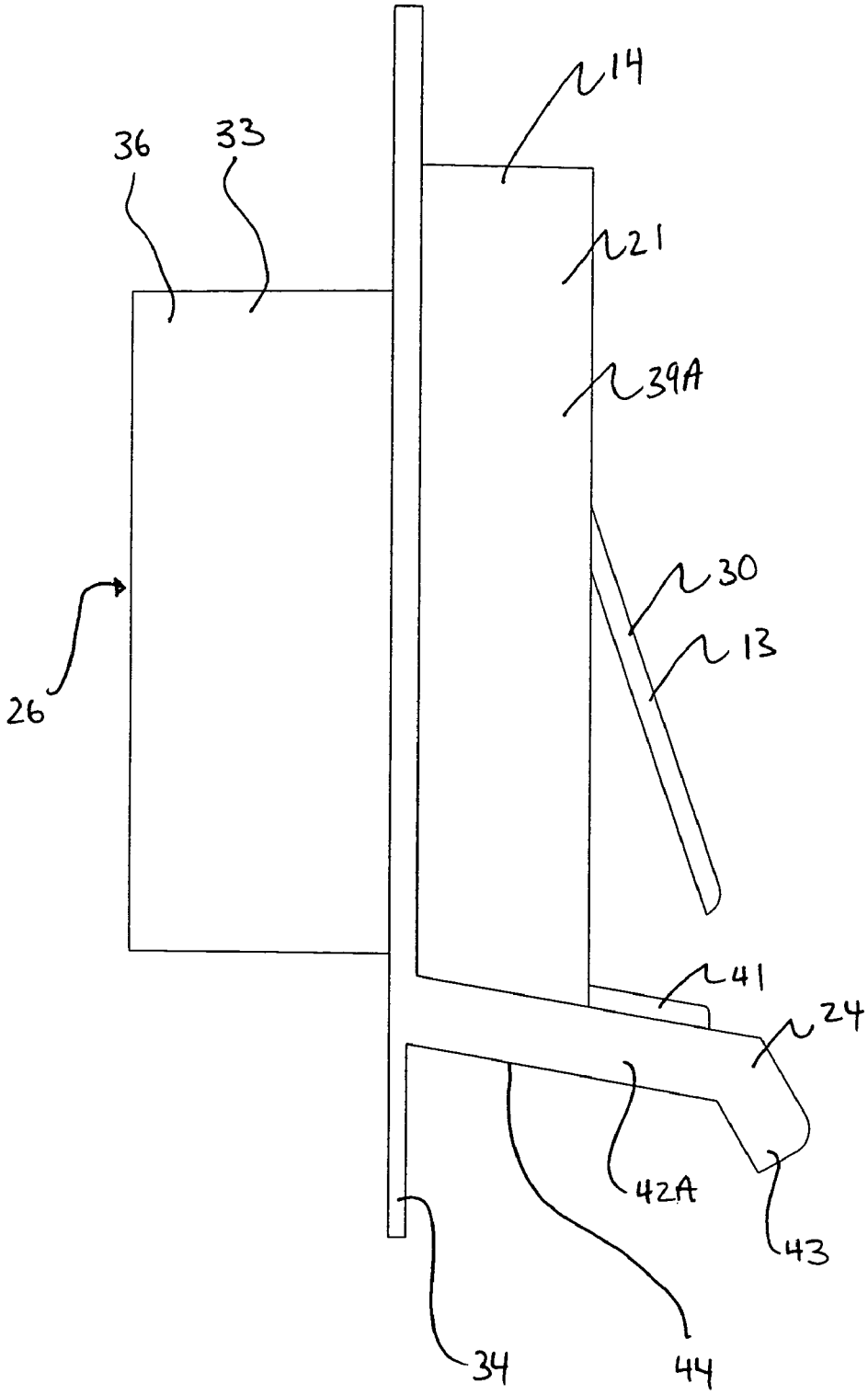
FIG. 10 is an elevated plan view of the right side of the vent of FIG. 1 with the vent cover removed.

As shown in FIGS. 6 and 7, vent cover flange 17 may incorporate a number of spaced apart apertures 18, through which screws or other fasteners (not shown) may be inserted to removably mount vent cover 12 to base 14. Preferably, the fasteners used to mount vent cover 12 to base 14 are non-permanent to facilitate removal of vent cover 12 from base 14. Vent cover flange 17 may incorporate portions 17A which project inwardly toward base 14. When vent cover 12 is mounted to base 14, vent cover flange portions 17A preferably form a snug fit with an inner transverse surface intermediate base flange 21 (see description below). Vent cover flange 17 may help to channel moisture away from vent 11 and may also provide structural reinforcement for vent 11.

Alternative embodiments of the invention may comprise alternative means for removably mounting vent cover 12 to base 14. For example, vent cover 12 may be removably connected to base 14 by other types of removable fasteners, such as staples, nails, rivets or the like. Vent cover 12 may be removably connected to base 14 with a pressure fit or a "snap-together" connection, wherein a male member on one of vent cover 12 or base 14 "snaps" into and is removably held in a corresponding female member on the opposing one of vent cover 12 and base 14. For example, vent cover 12 may include a member that projects (i.e. "snaps") into vent aperture 26, so as to hold vent cover 12 in place relative to base 14.

Hood 15 preferably extends outwardly and downwardly from base 14 to shelter building aperture 23, vent aperture 26 and hood aperture 29 from the elements. In the illustrated embodiment, hood 15 comprises a pair of sidewalls 15A, 15B, which extend from cover flange 17, and a curved top portion 25, which extends from cover flange 17 and arcs outwardly and downwardly between the curved edges of sidewalls 15A, 15B.

Moisture, which may collect on the top of the convex curved surface of top portion 25, is directed downwardly and outwardly away from building aperture 23, vent aperture 26, and hood aperture 29. Those skilled in the art will appreciate that hood 15 may have other shapes. For example, a hood may have a downwardly and outwardly angled and/or curved shape which performs the same function of directing moisture downwardly and outwardly away from building aperture 23, vent aperture 26, and hood aperture 29.

Grille 16 extends transversely between opposing edges of sidewalls 15A, 15B and extends inwardly from an outer edge of top portion 25. An inner edge of grill 16 may be held in place on base 14 by notches 47 in ribs 41 (see description below). In the illustrated embodiment, grille 16 comprises a grid of intercrossing bars 28 which defines a plurality of apertures 27. Apertures 27 permit the passage of gas through building aperture 23, vent aperture 26, and hood aperture 29, while deterring the entry other larger objects, such as leaves and animals, for example. Grille 16 may be provided by a number of alternative designs. For example, grille 16 may comprise a screen of fine mesh, a plate having several apertures therein, or any other design that permits the passage of gas. Grille 16 is not a required feature of vent 11. Hood 15 may alternatively comprise an aperture formed by sidewalls 15A, 15B, the outer edge of top portion 25 and base 14.

In the illustrated embodiment, damper member 13 is provided between vent aperture 26 and hood aperture 29 for controlling the flow of gas and/or other material therethrough. For example, damper member 13 may restrict the inward flow of gases and/or other material from hood aperture 29 through vent aperture 26 and into building aperture 23. Damper member 13 may be implemented in a wide variety of different forms. In the illustrated embodiment, damper member 13 comprises a flap 30 which is pivotally coupled to base 14 through a pair of hinge assemblies 31. Damper member 13 may comprise a different number of hinge assemblies 31. Hinge assemblies 31 permit the pivotal movement of flap 30 about hinge axis 32 (see FIG. 9). Flap 30 is preferably larger in cross-sectional area than vent aperture 26. Damper member 13 permits outward flow of gas from vent aperture 26 through hood aperture 29 when positive pressure of gas coming from vent aperture 26 causes flap 30 to pivot outwardly through hood aperture 29. However, damper member 13 restricts the inward flow of gas and other material from hood aperture 29 through vent aperture 26, because flap 30 is too large to pivot through vent aperture 26.

Each hinge assembly 31 preferably comprises a "snap-together" hinge structure made up of a damper hinge member 19 that extends from an edge of flap 30 and a base hinge member 20 that extends from base member 14. In the illustrated embodiment, damper hinge member 19 comprises a portion 19A that extends in the direction of hinge axis 32. Portion 19A may be cylindrical in shape. Base hinge member 20 is preferably semi-tubular in shape, such that portion 19A of damper hinge member 19 may "snap" into loose fit engagement with semi-tubular base hinge member 20 for pivotal motion therein.

The "snap-together" implementation of hinge assemblies 31 shown in the illustrated embodiment allows for simple removal and/or replacement of damper member 13. Those skilled in the art will appreciate that hinge assemblies 31 may be implemented with a wide variety of alternative hinge assemblies or alternative pivotal joint mechanisms. For example, hinge assemblies 31 may be implemented using conventional hinges which are mounted to both base 14 and flap 30 via screws, rivets, staples, nails or other fasteners. Preferably, the mechanisms used to implement hinge assemblies 31 permit the easy removal of damper member 13 from base 14 and/or easy replacement of damper member 13.

Base 14 comprises an interior base flange 33, which is located around a perimeter of vent aperture 26, an intermediate base flange 21, which surrounds and is spaced apart from interior base flange 33, and a mounting flange 34, which extends vertically and transversely to form a perimeter of base 14 and to provide a means for mounting vent 11 to a building surface. Base 14 may also comprise a plurality of fastener holes 40 positioned at spaced apart locations between interior base flange 33 and intermediate base flange 21 for receiving fasteners (not shown). Such fasteners may be used to mount vent cover 12 to base 14, as described above.

As shown in FIGS. 1, 7, 8 and 9, mounting flange 34 is substantially planar and extends vertically and transversely to form a perimeter of base 14. Mounting flange 34 preferably comprises a plurality of apertures 35 which penetrate mounting flange 34 at spaced apart locations. Suitable fasteners (e.g. screw, rivets, nails, staples or the like) may be inserted through apertures 35 to mount vent 11 to or between layers 22A, 22B of building wall 22. Fasteners used to mount base 14 to or between layers 22A, 22B of building wall 22 may not require apertures 35 and may simply be driven through mounting flange 34 and into internal wall layer 22A and/or into external wall layer 22B.

In the illustrated embodiment, base 14 also comprises a plurality of "blind holes" 48 at spaced apart locations between intermediate base flange 21 and interior base flange 33. Blind holes 48 represent particular locations where the thickness of base 14 is reduced so that fasteners may be more easily driven through base 14 and into internal wall layer 22A and/or into external wall layer 22B to mount base 14 between layers 22A, 22B of building wall 22.

Those skilled in the art will appreciate that other techniques may be used to mount base 14 to or between layers 22A, 22B of building wall 22. Such alternative mounting techniques may include glue, sealant or "snap-together" fittings wherein a portion of base 14 is sized for a snap-together fit with building aperture 23, for example. When mounted according to any of these techniques, the substantially planar and vertically and transversely extending profile of mounting flange 34 allows mounting flange 34 to extend between and substantially parallel to layers 22A, 22B of building wall 22.

Interior base flange 33 preferably forms a perimeter of vent aperture 26. When vent 11 is mounted to or within building wall 22, an inner portion 36 of interior base flange 33 may extend inwardly into building aperture 23 (FIG. 11). An outer portion 37 of interior base flange 33 extends outwardly towards vent cover 12. In the illustrated embodiment, outer portion 37 of interior base flange 33 is sized and shaped to be just smaller than flap 30 of damper member 13, so as to prevent damper member 13 from pivoting inwardly about hinge axis 32.

Intermediate base flange 21 surrounds and is spaced apart from interior base flange 33. Intermediate base flange 21 projects outwardly from base 14 and functions to move moisture away from vent aperture 26 and out from within building wall 22. In the illustrated embodiment, intermediate base flange 21 comprises an upper portion 38, a pair of side portions 39A, 39B and a downwardly sloping bottom drainage flange 24, all of which extend outwardly from base 14. In the illustrated embodiment, side portions 39 extend further outwardly than upper portion 38 and bottom drainage flange extends outwardly even further still. Upper portion 38 of intermediate base flange 21 may comprise a downwardly indented well 45 on each of its sides and side portions 39 of intermediate base flange 21 may extend upwardly past the level of wells 45. Wells 45 may help to prevent moisture running transversely on upper portion 38 from traveling transversely past side portions 39 and into wall 22.

Bottom drainage flange 24 may comprise a pair of dams 42, which extend upwardly from its side edges, and an outer drip lip 43, which extends more sharply downwardly at its outer edge. As shown in the illustrated embodiment, dams 42 are preferably located at the side edges of bottom drainage flange 24. In alternative embodiments, dams 42 may have other transverse locations. For example, dams 42 may be located between side portions 39 of intermediate base flange 21 and the side edges of bottom drainage flange 24 or dams 42 may be vertically aligned with side portions 39 of bottom drainage flange 24. In further alternative embodiments, the side edges of bottom drainage flange 24 may be vertically aligned with side portion 39 of bottom drainage flange 24.

Base 14 may also comprise one or more ribs 41 which extend outwardly from base 14 between bottom drainage flange 24 and interior base flange 33. Ribs 41 may comprise notches or similar cut-outs 47 which receive an inner edge of grill 16 when vent cover 12 is mounted to base 14.

As shown in FIG. 11, vent 11 is preferably installed between layers 22A, 22B of building wall 22 during the building's construction. Vent 11 is installed in a location where vent aperture 26 is in fluid communication with building aperture 23 to provide gas flow between the interior and exterior of the building. Base 14 is preferably mounted to internal wall layer 22A using fasteners which project through apertures 35 in mounting flange 34 and into internal wall layer 22A. Internal wall layer 22A may be a sheathing layer, for example. Preferably, when base 14 is mounted in this manner, inner portion 36 of interior base flange 33 extends inwardly into building aperture 23, such that building aperture 23 surrounds the peripheral edges of inner portion 36.

After mounting base 14 to internal wall layer 22A, the building may then be finished by applying one or more external wall layer(s) 22B over the outside of internal wall layer 22A. Such external wall layer(s) 22B may comprise vinyl siding, wood siding or stucco, for example. External wall layer(s) 22B are preferably cut, such that, when installed, they extend over mounting flange 34 and abut against intermediate base flange 21. More specifically, external wall layer(s) 22B may abut against the outer transverse surfaces of side portions 39 and the upper surface of upper portion 38 and against an undersurface 44 of bottom drainage flange 24. Bottom drainage flange 24 is sized such that after the installation of external wall layer(s) 22B, bottom drainage flange 24 extends outwardly past the outermost external wall layer 22B.

Interior base flange 33, side portions 39, upper portions 38 and wells 45 of intermediate base flange 21 and vent cover flange 17 help to direct moisture out from within wall 22, away from building aperture 23 and toward bottom-drainage flange 24. Moisture received on the top and side portions of interior base flange 33 may be conveyed along interior base flange 33 and downwardly to bottom drainage flange 24. Moisture received on the surfaces of side portions 39 of intermediate base flange 21 may also be directed downwardly along side portions 39 to bottom drainage flange 24. When moisture is received on upper portion 38 of intermediate base flange 21, it may be directed outwardly onto curved top portion 25 of hood 15 and/or transversely in either direction along upper portion 38 until it reaches one of wells 45. Once received in wells 45, such moisture may be directed outwardly to vent cover flange 17, which conveys the moisture downwardly to bottom drainage flange 24. Any moisture which may leak between vent cover flange 17 and side portions 39 of intermediate base flange 21 may be directed downwardly to bottom drainage flange 24 on an inside transverse surface of side portions 39.

Bottom drainage flange 24 extends outwardly past outermost wall layer 22B to provide a mechanism for removing moisture from within building wall 22 and directing the moisture away from building aperture 23. Moisture may be directed to bottom drainage flange as described above or may be received directly on bottom drainage flange 24. Once received on bottom drainage flange 24, moisture is directed downwardly and outwardly with gravity to the outside of building wall 22. Dams 42 prevent moisture from escaping transversely from the sides of bottom drainage flange 24 and outer drip lip 43 provides a drip edge to ensure that water droplets do not accumulate on bottom drainage flange 24.

Damper member 13 and vent cover 12 may be installed during construction or, preferably, after construction of wall 22 is completed. Damper member 13 may be pivotally attached to base 14 by snapping portions 19A of damper hinge members 19 into corresponding semi-tubular shaped base hinge members 20, as described above. Vent cover 12 is preferably mounted to base 14 using a plurality of fasteners which extend through apertures 18 and into fastener holes 40 of base 14. As discussed above, vent cover 12 may be mounted to base 14 using other mechanisms, such as snap-together fittings.

Vent 11 provides a number of advantages over the prior art. Vent 11 may be installed between layers 22A, 22B of building wall 22 as described above. If vent cover 12 or damper member 13 requires replacement (for example, because the component has broken), then vent cover 12 or damper member 13 may be removed from base 14 and replaced without having to remove base 14 from wall 22 and without having to dismantle any part of wall 22. In addition, vent 11 comprises bottom drainage flange 24 and a number of associated features which provide a mechanism for removing moisture from within building wall 22 and directing the moisture away from building aperture 23.

Figure 12:
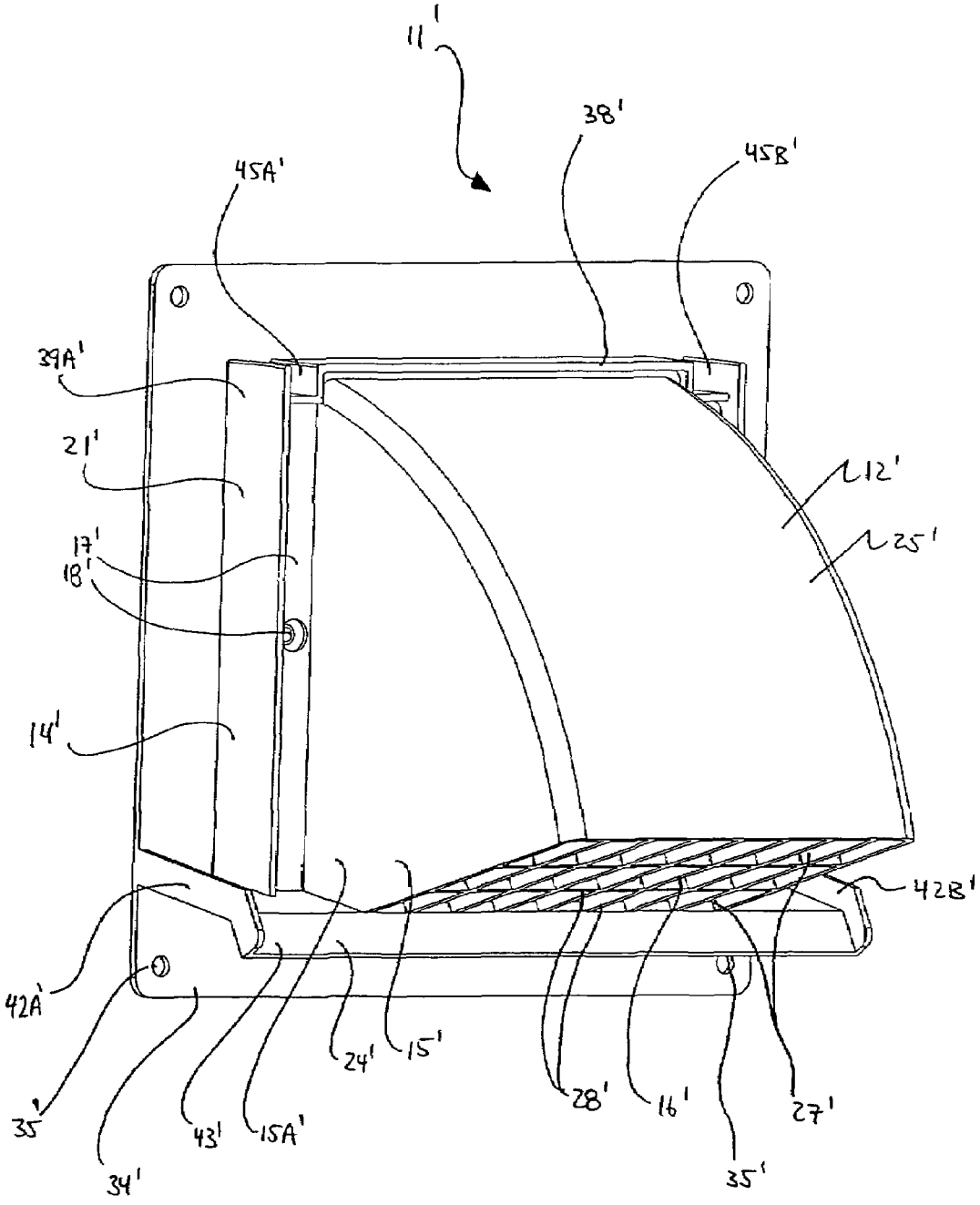
FIG. 12 is an isometric view of a vent apparatus according to an alternate embodiment of the invention.
Figure 13:
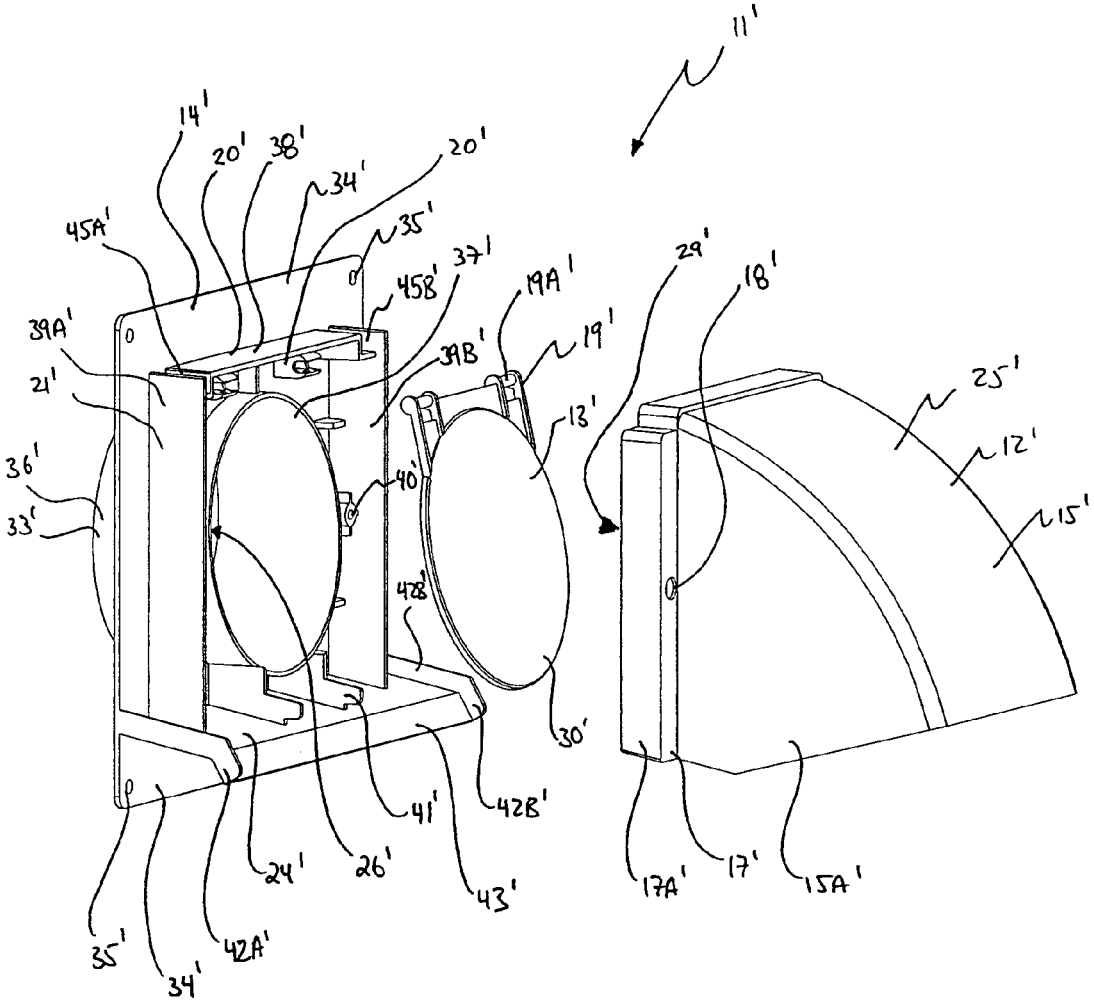
FIG. 13 is an exploded isometric view of the vent apparatus of FIG. 12.

FIGS. 12 and 13 depict a vent 11' according to an alternative embodiment of the invention. Vent 11' comprises many features which are the same or similar to the features of vent 11 depicted in FIGS. 1–11. The features of vent 11' are shown in FIGS. 12 and 13 with reference numbers corresponding to similar features of vent 11, except that the reference numerals for vent 11' (FIGS. 12 and 13) are followed by a "prime" symbol (').

As shown in FIGS. 12 and 13, vent 11' comprises a base 14', a damper member 13' and a vent cover 12'. Vent cover 12' and damper member 13' are removably mounted to base 14', which comprises a vent aperture 26'. Vent 11' is shaped differently than vent 11 and comprises a round vent aperture 26' and a round damper member 13'. Round-shaped vent aperture 26' and the round-shaped interior base flange 33' facilitate use of vent 11' with a round-shaped building aperture (not shown). In other respects, vent 11' is substantially similar to vent 11, comprising substantially similar components which function in a substantially similar manner. The components and functionality of vent 11' are not described further herein.

Figure 14:
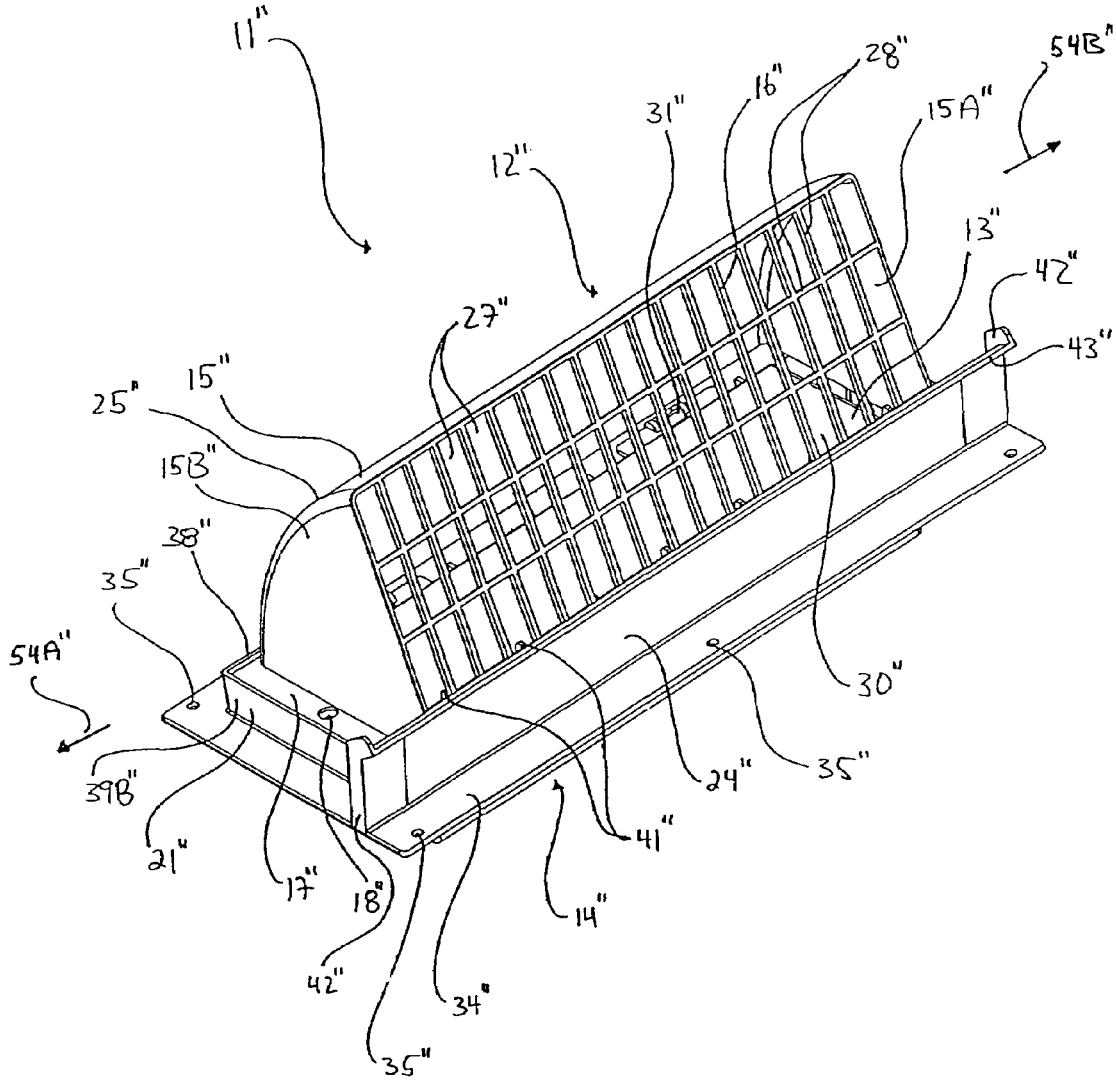
FIG. 14 is an isometric view of a vent apparatus according to another alternative embodiment of the invention.
Figure 15:
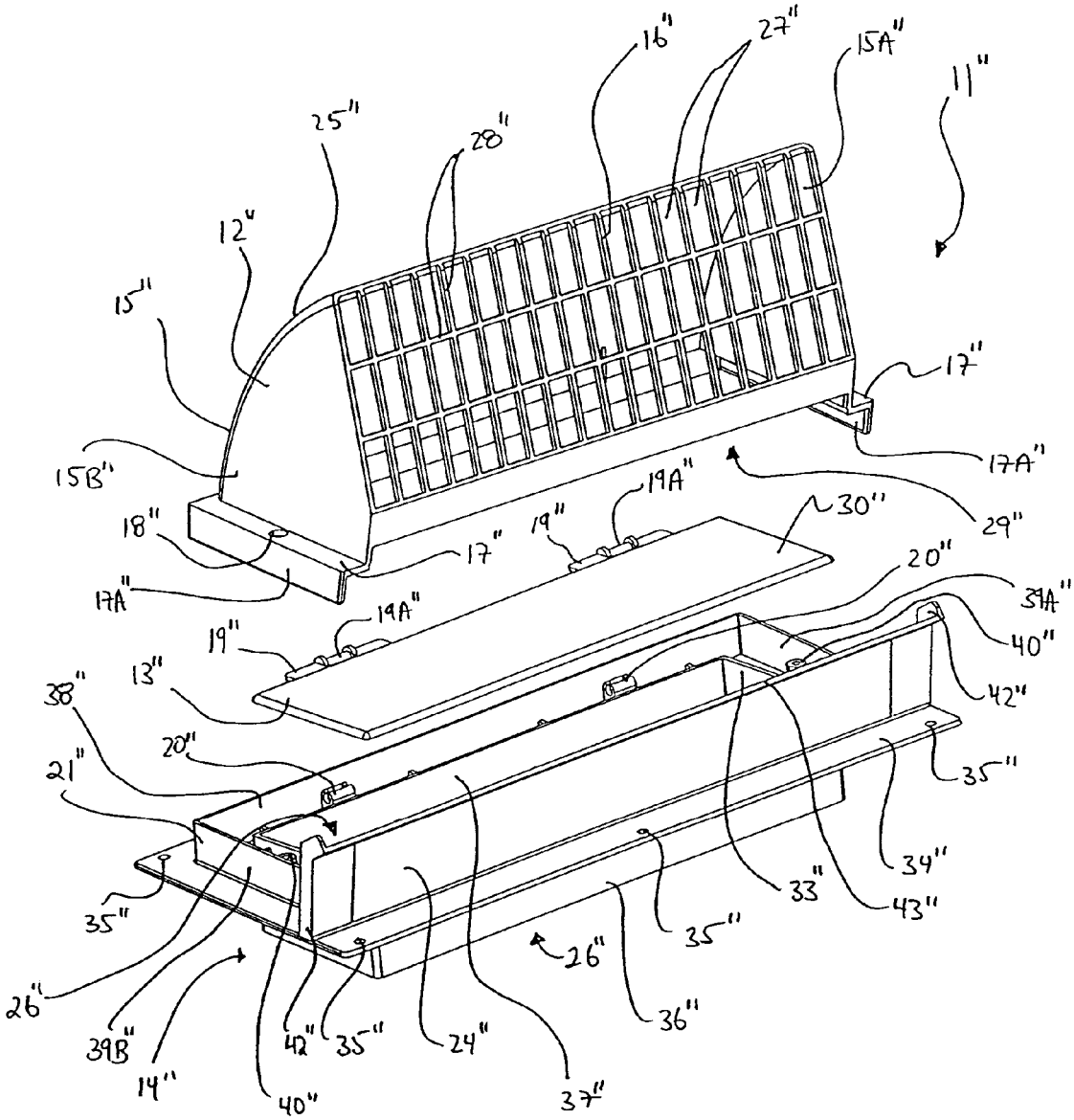
FIG. 15 is an exploded isometric view of the vent apparatus of FIG. 14.

FIGS. 14 and 15 depict a vent 11" according to another alternative embodiment of the invention. Vent 11" comprises many features which are the same or similar to the features of vent 11 depicted in FIGS. 1–11. The features of vent 11" are shown in FIGS. 14 and 15 with reference numbers corresponding to similar features of vent 11, except that the reference numerals for vent 11" (FIGS. 14 and 15) are followed by a "double prime" symbol ("). Vent 11" of FIGS. 14 and 15 is substantially similar to vent 11, except that side portions 39" and upper portion 38" of intermediate base flange 21" extend outwardly by the same amount and intermediate base flange 21" does not include wells 45. Moisture received on upper portion 38" of intermediate base flange 21" may be directed transversely to side portions 39", where it may be conveyed downwardly to bottom drainage flange 24". In other respects, vent 11" is substantially similar to vent 11, comprising substantially similar components which function in a substantially similar manner. The components and functionality of vent 11" are not described further herein.

As will be apparent to those skilled in the art in the light of the foregoing disclosure, many alterations and modifications are possible in the practice of this invention without departing from the spirit or scope thereof. For example:

Damper member 13 is not a necessary feature of the invention. Vent cover 12 and base 14 may, when mounted to one another, provide sufficient weatherproofing and prevent entry of foreign material into associated building aperture 23.

As demonstrated by the embodiments described above, the shape of the vent of the present invention may be changed, for example to suit the associated building aperture(s), to suit the angle of the building wall within which it is mounted, and/or to suit the environmental conditions in which it is deployed.

The embodiments described above are preferably mounted between the layers of a building wall. Those skilled in the art will appreciate that by changing the shape of certain components, such as the vent cover, the vent of the present invention may be implemented on other building surfaces, such as a roof, for example.

Accordingly, the scope of the invention is to be construed in accordance with the substance defined by the following claims.

What is claimed is:

1. A vent, which together with one or more building apertures, provides a route for gas flow through a building surface, the vent comprising:

a base member having a vent aperture through a surface thereof, the base member comprising a generally planar mounting flange on at least a portion of a perimeter thereof for mounting the base member within a building surface such that the vent aperture is in fluid communication with the one or more building apertures, the mounting flange shaped to permit at least a portion of the mounting flange to extend between an internal building surface layer and one or more external building surface layers in a direction generally parallel to at least one of: the internal building surface layer and the one or more external building surface layers; and a vent cover which is removably mountable to the base member when the base member is mounted within a building surface and the portion of the mounting flange extends between the internal building surface layer and the one or more external building surface layers, the vent cover comprising a hood member which, when the vent cover is mounted on the base member, projects downwardly and outwardly from the base member for conveying moisture away from the vent aperture.

2. The vent of claim 1 wherein the base member comprises an outwardly projecting intermediate base flange which is spaced apart from the vent aperture, the intermediate base flange comprising a bottom drainage flange which projects outwardly and downwardly from beneath the vent aperture for conveying moisture on a surface thereof, wherein when the base member is mounted within a building surface, an outermost edge of the bottom drainage flange projects outwardly past the outermost one of the one or more external building surface layers.

3. The vent of claim 2 wherein the intermediate base flange comprises a pair of outwardly projecting side portions which extend upwardly from above the bottom drainage flange on either side of the vent aperture.

4. The vent of claim 3 wherein the intermediate base flange comprises an outwardly projecting upper portion located above the vent aperture and extending between the two side portions of the intermediate base flange.

5. A vent, which together with one or more building apertures, provides a route for gas flow through a building surface, the vent comprising:

a base member having a vent aperture through a surface thereof, the base member comprising a generally planar mounting flange on at least a portion of a perimeter thereof for mounting the base member within a building surface, wherein when the base member is mounted within a building surface, at least a portion of the mounting flange extends between an internal building surface layer and one or more external building surface layers and the vent aperture is in fluid communication with the one or more building apertures; and, a vent cover which is removably mountable to the base member when the base member is mounted within a building surface, the vent cover comprising a hood member which, when the vent cover is mounted on the base member, projects downwardly and outwardly from the base member for conveying moisture away from the vent aperture;

wherein the base member comprises an outwardly projecting intermediate base flange which is spaced apart from the vent aperture, the intermediate base flange comprising a bottom drainage flange which projects outwardly and downwardly from beneath the vent aperture for conveying moisture on a surface thereof, wherein when the base member is mounted within a building surface, an outermost edge of the bottom drainage flange projects outwardly past the outermost one of the one or more external building surface layers;

wherein the intermediate base flange comprises a pair of outwardly projecting side portions which extend upwardly from above the bottom drainage flange on either side of the vent aperture;

wherein the intermediate base flange comprises an outwardly projecting upper portion located above the vent aperture and extending between the two side portions of the intermediate base flange; and wherein the upper portion of the intermediate base flange comprises a transversely extending main section and a pair of wells, each well extending downwardly and transversely from a corresponding transverse end of the main section to meet with a corresponding one of the side portions of the intermediate base flange below an upwardmost end of the corresponding side portion.

6. The vent of claim 2 wherein the intermediate base flange comprises an outwardly projecting, transversely extending upper portion located above the vent aperture.

7. A vent, which together with one or more building apertures, provides a route for gas flow through a building surface, the vent comprising:

a base member having a vent aperture through a surface thereof, the base member comprising a generally planar mounting flange on at least a portion of a perimeter thereof for mounting the base member within a building surface, wherein when the base member is mounted within a building surface, at least a portion of the mounting flange extends between an internal building surface layer and one or more external building surface layers and the vent aperture is in fluid communication with the one or more building apertures; and, a vent cover which is removably mountable to the base member when the base member is mounted within a building surface, the vent cover comprising a hood member which, when the vent cover is mounted on the base member, projects downwardly and outwardly from the base member for conveying moisture away from the vent aperture;

wherein the base member comprises an outwardly projecting intermediate base flange which is spaced apart from the vent aperture, the intermediate base flange comprising a bottom drainage flange which projects outwardly and downwardly from beneath the vent aperture for conveying moisture on a surface thereof, wherein when the base member is mounted within a building surface, an outermost edge of the bottom drainage flange projects outwardly past the outermost one of the one or more external building surface layers;

wherein the intermediate base flange comprises a pair of outwardly projecting side portions which extend upwardly from above the bottom drainage flange on either side of the vent aperture;

wherein the intermediate base flange comprises an outwardly projecting upper portion located above the vent aperture and extending between the two side portions of the intermediate base flange; and wherein, when the vent cover is mounted to the base member, an upper surface of the hood member fits under the upper portion of the intermediate base flange.

8. The vent of claim 4 wherein, when the base member is mounted within a building surface, the one or more external building surface layers abut against the side portions and the upper portion of the intermediate base flange.

9. The vent of claim 2 wherein, when the base member is mounted within a building surface, the one or more external building surface layers abut against an undersurface of the bottom drainage flange.

10. A vent, which together with one or more building apertures, provides a route for gas flow through a building surface, the vent comprising:

a base member having a vent aperture through a surface thereof, the base member comprising a generally planar mounting flange on at least a portion of a perimeter thereof for mounting the base member within a building, surface, wherein when the base member is mounted within a building surface, at least a portion of the mounting flange extends between an internal building surface layer and one or more external building surface layers and the vent aperture is in fluid communication with the one or more building apertures; and, a vent cover which is removably mountable to the base member when the base member is mounted within a building surface, the vent cover comprising a hood member which, when the vent cover is mounted on the base member, projects downwardly and outwardly from the base member for conveying moisture away from the vent aperture;

wherein the base member comprises an outwardly projecting intermediate base flange which is spaced apart from the vent aperture, the intermediate base flange comprising a bottom drainage flange which projects outwardly and downwardly from beneath the vent aperture for conveying moisture on a surface thereof, wherein when the base member is mounted within a building surface, an outermost edge of the bottom drainage flange projects outwardly past the outermost one of the one or more external building surface layers;

wherein the intermediate base flange comprises a pair of outwardly projecting side portions which extend upwardly from above the bottom drainage flange en either side of the vent aperture; and wherein the bottom drainage flange comprises two side edges located on either side of the vent aperture and wherein the side portions of the intermediate base flange extend upwardly from above the bottom drainage flange at locations that are transversely closer to the vent aperture than the side edges of the bottom drainage flange.

11. The vent of claim 10 wherein each side edge of the bottom drainage flange comprises a dam which projects upwardly from the side edge for preventing moisture received on an upper surface of the bottom drainage flange from travelling transversely past the side edges of the bottom drainage flange.

12. A vent, which together with one or more building apertures, provides a route for gas flow through a building surface, the vent comprising:

a base member having a vent aperture through a surface thereof, the base member comprising a generally planar mounting flange on at least a portion of a perimeter thereof for mounting the base member within a building surface, wherein when the base member is mounted within a building, surface, at least a portion of the mounting flange extends between an internal building surface layer and one or more external building surface layers and the vent aperture is in fluid communication with the one or more building apertures; and, a vent cover which is removably mountable to the base member when the base member is mounted within a building surface, the vent cover comprising a hood member which, when the vent cover is mounted on the base member, projects downwardly and outwardly from the base member for conveying moisture away from the vent aperture;

wherein the base member comprises an outwardly projecting intermediate base flange which is spaced apart from the vent aperture, the intermediate base flange comprising a bottom drainage flange which projects outwardly and downwardly from beneath the vent aperture for conveying moisture on a surface thereof, wherein when the base member is mounted within a building surface, an outermost edge of the bottom drainage flange projects outwardly past the outermost one of the one or more external building surface layers;

wherein the intermediate base flange comprises a pair of outwardly projecting side portions which extend upwardly from above the bottom drainage flange on either side of the vent aperture;

the vent further comprising a pair of dams which project upwardly from an upper surface of the bottom drainage flange at locations aligned with the side portions of the intermediate base flange for preventing moisture received on the upper surface of the bottom drainage flange from travelling transversely past the side edges of the bottom drainage flange.

13. The vent of claim 1 comprising one or more releasable fasteners for removably holding the vent cover to the base member.

14. The vent of claim 13 wherein at least one of the one or more releasable fasteners comprises a snap together connection.

15. The vent of claim 2 wherein the vent cover comprises an apertured grille which extends inwardly from an outer edge of the hood member.

16. The vent of claim 15 comprising one or more ribs which extend upwardly from and outwardly along an upper surface of the bottom drainage flange at spaced apart locations, each rib comprising a notch for receiving an inward edge of the grille.

17. The vent of claim 1 wherein the base member comprises an interior base flange, an inner portion of which projects inwardly into the one or more building apertures.

18. The vent of claim 17 wherein the interior base flange comprises an outwardly projecting outer portion.

19. The vent of claim 17 wherein the interior base flange is located on a perimeter of the vent aperture.

20. The vent of claim 1 comprising a damper member which is pivotally coupled to the base member.

21. The vent of claim 20 wherein the vent aperture is sized to prevent the damper member from pivoting therethrough.

22. The vent of claim 20 wherein the damper member is removably coupled to the base member.

23. The vent of claim 22 wherein the damper member is removably and pivotally coupled to the base member by one or more snap-together hinge assemblies.

24. The vent of claim 1 comprising a damper member which is pivotally coupled to the vent cover.

25. The vent of claim 1 wherein the mounting flange projects from a transverse side of the vent aperture to form a transverse part of the perimeter of the base member.

26. The vent of claim 1 wherein the mounting flange projects from a vertical side of the vent aperture to form a vertical part of the perimeter of the base member.

27. A vent, which together with one or more building apertures, provides a route for gas flow through a building surface, the vent having a base member mountable within the building surface, the base member comprising:

a generally planar mounting flange on at least a portion of a perimeter of the base member for mounting the base member within the building surface, the mounting flange shaped to permit at least a portion of the mounting flange to extend between an internal building surface layer and one or more external building surface layers in a direction generally parallel to at least one of: the internal building surface layer, and the one or more external building surface layers;

a vent aperture in fluid communication with the one or more building apertures when the base member is mounted within the building surface; and an outwardly projecting intermediate base flange which is spaced apart from the vent aperture, the intermediate base flange comprising a bottom drainage flange which projects outwardly and downwardly from beneath the vent aperture for conveying moisture on a surface thereof, wherein when the base member is mounted within the building surface and the portion of the mounting flange extends between the internal building surface layer and the one or more external building surface layers, the bottom drainage flange projects outwardly from the mounting flange past an outermost one of the one or more external building surface layers.

28. The vent of claim 27 wherein the intermediate base flange comprises a pair of outwardly projecting side portions which extend upwardly from above the bottom drainage flange on either side of the vent aperture.

29. The vent of claim 28 wherein the intermediate base flange comprises an outwardly projecting upper portion located above the vent aperture which extends between the two side portions.

30. The vent of claim 29 comprising a vent cover which is removably mountable to the base member when the base member is mounted within the building surface, the vent cover comprising a hood member which, when the vent cover is mounted on the base member, projects downwardly and outwardly from the base member for conveying moisture away from the vent aperture.

31. A vent, which together with one or more building apertures, provides a route for gas flow through a building surface, the vent having a base member mountable within the building surface, the base member comprising:

a generally planar mounting flange on at least a portion of a perimeter of the base member for mounting the base member within the building surface, wherein when the base member is mounted within the building surface, at least a portion of the mounting flange extends between an internal building surface layer and one or more external building surface layers;

a vent aperture in fluid communication with the one or more building apertures when the base member is mounted within the building surface;

an outwardly projecting intermediate base flange which is spaced apart from the vent aperture, the intermediate base flange comprising a bottom drainage flange which projects outwardly and downwardly from beneath the vent aperture for conveying moisture on a surface thereof, wherein when the base member is mounted within the building surface, an outermost edge of the bottom drainage flange projects outwardly past an outermost one of the one or more external building surface layers; and a vent cover which is removably mountable to the base member when the base member is mounted within the building surface, the vent cover comprising a hood member which, when the vent cover is mounted on the base member, projects downwardly and outwardly from the base member for conveying moisture away from the vent aperture;

wherein the intermediate base flange comprises a pair of outwardly projecting side portions which extend upwardly from above the bottom drainage, flange on either side of the vent aperture; and wherein the intermediate base flange comprises an outwardly projecting upper portion located above the vent aperture which extends between the two side portions wherein, when the vent cover is mounted to the base member, an upper surface of the hood member fits under the upper portion of the intermediate base flange.

32. The vent of claim 29 wherein, when the base member is mounted within the building surface, the one or more external building surface layers abut against the side portions and the upper portion of the intermediate base flange.

33. The vent of claim 27 wherein, when the base member is mounted within the building surface, the one or more external building surface layers abut against an undersurface of the bottom drainage flange.

34. A vent, which together with one or more building apertures, provides a route for gas flow through a building surface, the vent having a base member mountable within the building surface, the base member comprising:

a generally planar mounting flange on at least a portion of a perimeter of the base member for mounting the base member within the building surface, wherein when the base member is mounted within the building surface, at least a portion of the mounting flange extends between an internal building surface layer and one or more external building surface layers;

a vent aperture in fluid communication with the one or more building apertures when the base member is mounted within the building surface; and an outwardly projecting intermediate base flange which is spaced apart from the vent aperture, the intermediate base flange comprising a bottom drainage flange which projects outwardly and downwardly from beneath the vent aperture for conveying moisture on a surface thereof, wherein when the base member is mounted within the building surface, an outermost edge of the bottom drainage flange projects outwardly past an outermost one of the one or more external building surface layers;

wherein the intermediate base flange comprises a pair of outwardly projecting side portions which extend upwardly from above the bottom drainage flange on either side of the vent aperture; and wherein the bottom drainage flange comprises two side edges located on either side of the vent aperture and wherein the side portions of the intermediate base flange extend upwardly from above the bottom drainage flange at locations that are transversely closer to the vent aperture than the side edges of the bottom drainage flange.

35. The vent of claim 34 wherein each side edge of the bottom drainage flange comprises a dam which projects upwardly from the side edge for preventing moisture received on an upper surface of the bottom drainage flange from travelling transversely past the side edges of the bottom drainage flange.

36. The vent of claim 27 wherein the base member comprises an interior base flange, an inner portion of which projects inwardly into the one or more building apertures.

37. A vent comprising:

a base member having a vent aperture extending between inward and outward sides of the base member and a substantially planar mounting flange on at least a portion of its perimeter, at least a portion of the mounting flange extending between layers of a multiple layer building surface in a direction generally parallel to the building surface for mounting the base member within the building surface; and a vent cover removably coupleable to the outward side of the base member when the portion of the mounting flange extends between the internal building surface layer and the one or more external building surface layers, the vent cover comprising a hood member disposed to shield the vent aperture.

38. The vent of claim 37 wherein the base member comprises an outwardly projecting intermediate base flange which is spaced apart from the vent aperture, the intermediate base flange comprising a bottom drainage flange which projects outwardly and downwardly from beneath the vent aperture for conveying moisture on a surface thereof, wherein when the mounting flange is received between the layers of the building surface, an outermost edge of the bottom drainage flange projects outwardly past the outermost one of the one or more external building surface layers.

39. The vent of claim 38 wherein the intermediate base flange comprises a pair of outwardly projecting side portions which extend upwardly from above the bottom drainage flange on either side of the vent aperture.

40. The vent of claim 39 wherein the intermediate base flange comprises an outwardly projecting upper portion located above the vent aperture and extending between the two side portions of the intermediate base flange.

41. The vent of claim 37 wherein the base member comprises an interior base flange, an inner portion of which projects inwardly from the inward side of the base member.

42. A method for installing a vent within a building surface to provide fluid communication through one or more building apertures in the building surface, the method comprising:

mounting a base member to an internal building surface layer such that a vent aperture in the base member is in fluid communication with the one or more building apertures;

after mounting the base member, installing one or more external building surface layers onto the internal building surface layer, such that the one or more external building surface layers overlap a portion of the base member, the base member having a substantially planar mounting flange on at least a portion of its perimeter, at least a portion of the mounting flange extending between the internal and external building surface layers in a direction generally parallel to the building surface; and after installing one or more external building surface layers, removably mounting a vent cover to the base member, the vent cover extending downwardly and outwardly from above the vent aperture to a location that is outside of the outermost one of the one or more external building surface layers.

* * * * *

UNITED STATES PATENT AND TRADEMARK OFFICE

CERTIFICATE OF CORRECTION

PATENT NO. : 6,974,379 B2
APPLICATION NO. : 10/612270
DATED : December 13, 2005
INVENTOR(S) : Juergen Koessler It is certified that error appears in the above-identified patent and that said Letters Patent is hereby corrected as shown below:

In Figure 11 of the Drawings and in the drawing reproduced on the cover page of the issued patent, the reference numeral appearing as "56" is corrected to read --58--.

In Figure 11 of the Drawings and in the drawing reproduced on the cover page of the issued patent, the reference numeral appearing as "58" is corrected to read --56--.

Signed and Sealed this
Fifth Day of February, 2013

Teresa Stanek Rea
*Acting Director of the United States Patent and Trademark Office*